US009950839B2

(12) United States Patent
Adams

(10) Patent No.: US 9,950,839 B2
(45) Date of Patent: Apr. 24, 2018

(54) SPOUT

(71) Applicant: Omar Adams, Bellevue, WA (US)

(72) Inventor: Omar Adams, Bellevue, WA (US)

( * ) Notice: Subject to any disclaimer, the term of this patent is extended or adjusted under 35 U.S.C. 154(b) by 0 days.

(21) Appl. No.: 14/875,339

(22) Filed: Oct. 5, 2015

(65) Prior Publication Data

US 2017/0096259 A1 Apr. 6, 2017

(51) Int. Cl.

| | |
|---|---|
| ***B65D 25/48*** | (2006.01) |
| ***B65D 25/38*** | (2006.01) |
| ***B65D 25/42*** | (2006.01) |
| ***B44D 3/12*** | (2006.01) |
| ***B65D 47/06*** | (2006.01) |

(52) U.S. Cl.

CPC ..... *B65D 25/48* (2013.01); *B65D 47/06* (2013.01); *B44D 3/12* (2013.01); *B44D 3/128* (2013.01); *B65D 2231/007* (2013.01); *B65D 2517/0049* (2013.01)

(58) Field of Classification Search

CPC .. B65D 25/48; B65D 47/06; B65D 2231/007; B65D 2517/0049; B44D 3/12; B44D 3/128

See application file for complete search history.

(56) References Cited

U.S. PATENT DOCUMENTS 1,865,736 A * 7/1932 Astley ..... B44D 3/14 220/4.03
1,867,060 A * 7/1932 Carr ..... B65D 25/48 215/392
1,952,288 A * 3/1934 Saxon ..... B65D 25/48 220/733
1,959,584 A * 5/1934 Hurley ..... B65D 25/48 210/466
2,155,049 A * 4/1939 Isaacson ..... B65D 47/06 220/717
2,185,413 A * 1/1940 Masterson ..... B65D 25/48 220/694
2,564,979 A * 8/1951 Jorgensen ..... B65D 25/48 215/391
2,594,858 A * 4/1952 Bowman ..... B65D 25/48 222/567
2,720,346 A * 10/1955 Compton ..... B65D 25/48 220/697
2,767,891 A * 10/1956 Beadles ..... B65D 25/48 220/701

(Continued)

*Primary Examiner* — Frederick C Nicolas
(74) *Attorney, Agent, or Firm* — Michelle E. Carey; Telekta Law, P.S.

(57) ABSTRACT

A semi-flexible device configured to act as a spout or funnel for medium to large size containers. When flat, the device is trapezoidal in shape, with the top narrower than the bottom, and the sides angled to connect the top to the bottom. When used as a spout, the device is semi-circular in profile, configured to follow the shape of a container rim. When used as a funnel, the device is circular in profile, configured to fit into a hole such as the opening of a jar. The device includes at least one edge that includes two lips or rims close together but separable, the gap between which is configured to receive the rim of a container. At least one of frictional force of the lips on the container rim and pressing force of the device pushing against the more rigid container holds the device onto the container rim.

15 Claims, 6 Drawing Sheets

(56) References Cited

U.S. PATENT DOCUMENTS

| | | | | | |
|---|---|---|---|---|---|
| 3,102,667 | A * | 9/1963 | Ullevig | B65D 25/48 | 222/569 |
| 3,309,000 | A * | 3/1967 | Haverstick | B44D 3/12 | 220/4.03 |
| 3,400,867 | A * | 9/1968 | Giannone | B44D 3/12 | 222/570 |
| 3,853,249 | A * | 12/1974 | Weir, Jr. | B65D 25/48 | 222/570 |
| 3,961,732 | A * | 6/1976 | Roberts | B65D 25/48 | 222/570 |
| 4,009,805 | A * | 3/1977 | Klygis | B65D 25/42 | 206/820 |
| 5,195,662 | A * | 3/1993 | Neff | B65D 25/48 | 220/700 |
| 5,392,969 | A * | 2/1995 | Usery | B65D 25/48 | 220/695 |
| 9,475,613 | B2 * | 10/2016 | Kent | B44D 3/128 | |

* cited by examiner

SPOUT

FIELD OF THE INVENTION

This invention relates generally to spouts, and, more specifically, to detachable spouts and funnels for large containers.

BACKGROUND OF THE INVENTION

Big containers such as large buckets or paint cans are not generally designed for the easy pouring of the contents therein. Attempted pouring can cause spillage, waste, leaking, and staining of the area around the container. Furthermore, using different sizes of containers results in the need for multiple tools in order to access the contents. These are just some of the problems with large containers that are overcome by the present invention.

SUMMARY OF THE INVENTION

The present invention relates generally to spouts, and, more specifically, to detachable spouts and funnels for large containers.

In some embodiments, the spout may be comprised of an upper rim; a lower rim, wherein the lower rim includes a grip running longitudinally with the rim; a body portion disposed between the upper rim and the lower rim; and the upper rim, lower rim, and body portion my be substantially trapezoidal in shape. In some embodiments, the spout may be configured to be rolled into a cone. In some embodiments, the grip may be comprised of: an upper lip; a lower lip; and the body portion coupled with the upper lip and the lower lip. In some embodiments, the grip may be configured for receiving a rim of at least one of a bottle, can, jar, bucket, or other container. In some embodiments, the body portion may be further comprised of: a first edge and a second edge, wherein the edges form angular portions of the trapezoidal shape; and wherein folding the first edge over the second edge forms a cone.

In some embodiments, the spout may be comprised of: an upper rim; a lower rim, the lower rim including: an upper lip; and a lower lip; and a body portion disposed between and coupled with the upper rim and the lower rim. 7. In some embodiments, the body portion may be substantially trapezoidal in shape. In some embodiments, the spout may be further comprised of: a first edge and a second edge, wherein the edges form angular sides of the trapezoid; wherein the upper rim forms a shorter leg of the trapezoid; and wherein the lower rim forms a longer leg of the trapezoid. In some embodiments, the upper lip and the lower lip may form a gap along the lower rim of the spout. In a further embodiment, the gap between the upper lip and the lower lip may be comprised of the same material as the body portion. In some embodiments, the upper rim and the body portion are semi-flexible. In some embodiments, the lower rim may be semi-flexible longitudinally. In some embodiments, the lower rim may be rigid transversely.

In some embodiments, the spout may be comprised of: an upper rim; a lower rim, the lower rim including: an upper lip; a lower lip; and wherein the upper lip and the lower lip form a gap along the lower rim; a body portion disposed between and coupled with the upper rim and the lower rim; a first edge; and a second edge, wherein the first edge and the second edge transverse the body portion from upper rim to lower rim. In some embodiments, the upper rim and the body portion may be semi-flexible. In some embodiments, the lower rim may be semi-flexible longitudinally. In some embodiments, the lower rim may be rigid transversely. In some embodiments, the spout may be configured to be substantially conical in shape when rolled. In some embodiments, the lower rim exerts a lateral force extending outwardly away from a longitudinal axis of the cone. In some embodiments, the lower rim may exert a lateral force extending outwardly away from a longitudinal axis of the spout.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

This invention relates generally to spouts, and, more specifically, to detachable spouts and funnels for large containers.

Specific details of certain embodiments of the invention are set forth in the following description and in FIGS. 1-9 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
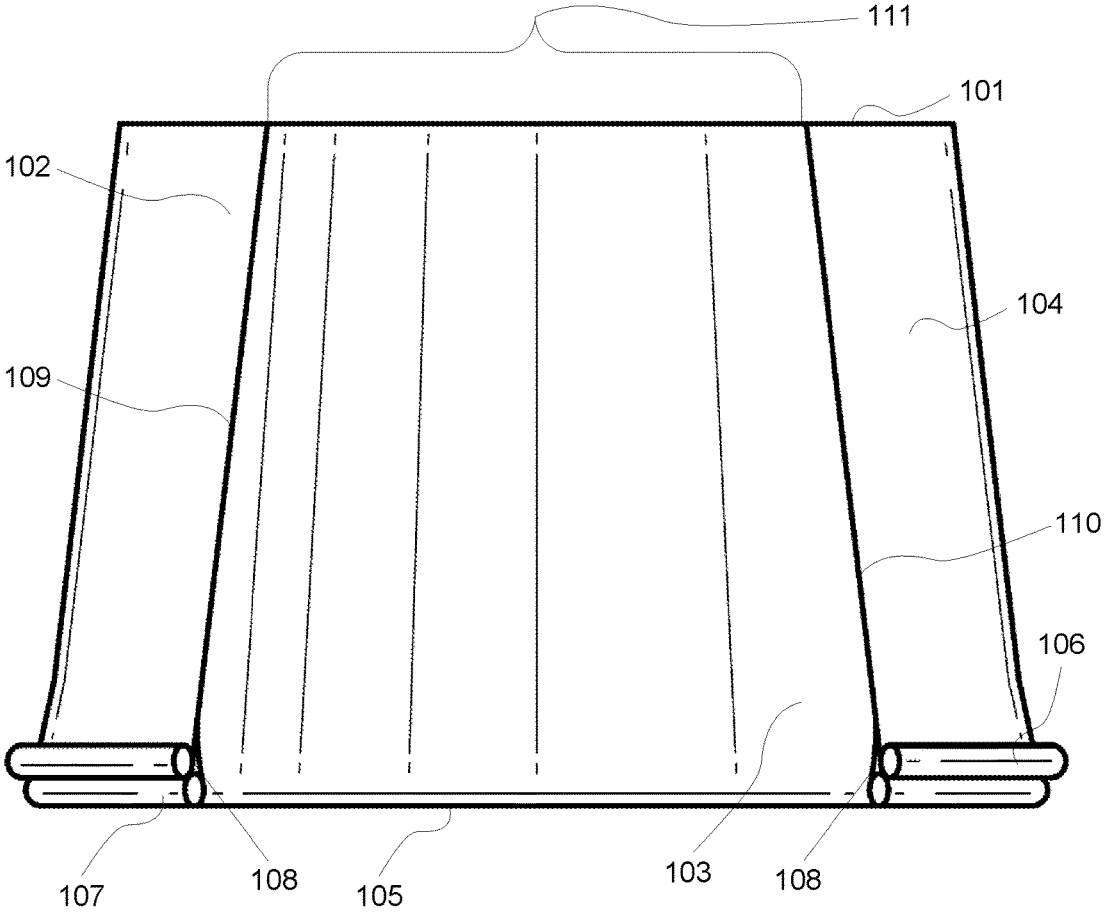
FIG. 1 is a front view of the detachable spout

FIG. 1 is a front view of spout 100. Spout 100 is comprised essentially of a body 102 and a lower rim 105. Body 102 may generally include an inner surface 103 and outer surface 104. In some embodiments, spout 100 may include upper rim 101, left edge 109, and right edge 110. In some embodiments, upper rim 101, left edge 109, right edge 110, and lower rim 105 may generally form a rectangular shape. In other embodiments, the shape of body 102 may generally resemble a trapezoid, wherein lower rim 105 is relatively longer than upper rim 101, and wherein left edge 109 and right edge 110 angle inward from lower rim to upper rim, or outward from upper rim to lower rim. It should be understood that edge angle and general shape of spout 100 can change without significantly altering the function of the spout. In some embodiments, spout 100 may be substantially curved, such that the rectangular or trapezoidal shape formed by the rims and edges form a substantially conical shape. In one further embodiment, spout 100 may be comprised of a rigid material that holds this conical shape. In other embodiments, spout 100 may be comprised of a flexible or semi-rigid, interchangeable herein with semi-flexible, material capable of being rolled or folded into a conical shape. In still other embodiments, spout 100 may have a flexible or semi-flexible body 102, and may be formed into a conical shape by upper rim 101 or lower rim 105 causing edges 109 and 110 to curve toward one another by exerting a force inward toward a longitudinal axis of the spout. In other embodiments, one or both of upper rim 101 and lower rim 105 may exert a force outward away from a longitudinal axis of spout 100. In some embodiments, the conical shape of spout 100 leaves a gap 111 between edges 109 and 110. In other embodiments, the conical shape of spout 100 leaves no gap 111, forming a spout that also functions as a funnel.

In some embodiments, lower rim 105 is further comprised of upper lip 106 and lower lip 107. In some further embodiments, gap 108 is formed between upper lip 106 and lower lip 107. In some embodiments, upper lip 106 is permanently coupled with lower lip 107 by way of body 102. In other embodiments, either one of upper lip 106 or lower lip 107 may be removable. In one further embodiment, one of removable upper lip 106 or lower lip 107 may couple directly with the other lip, or it may removably couple with body 102.

Figure 2:
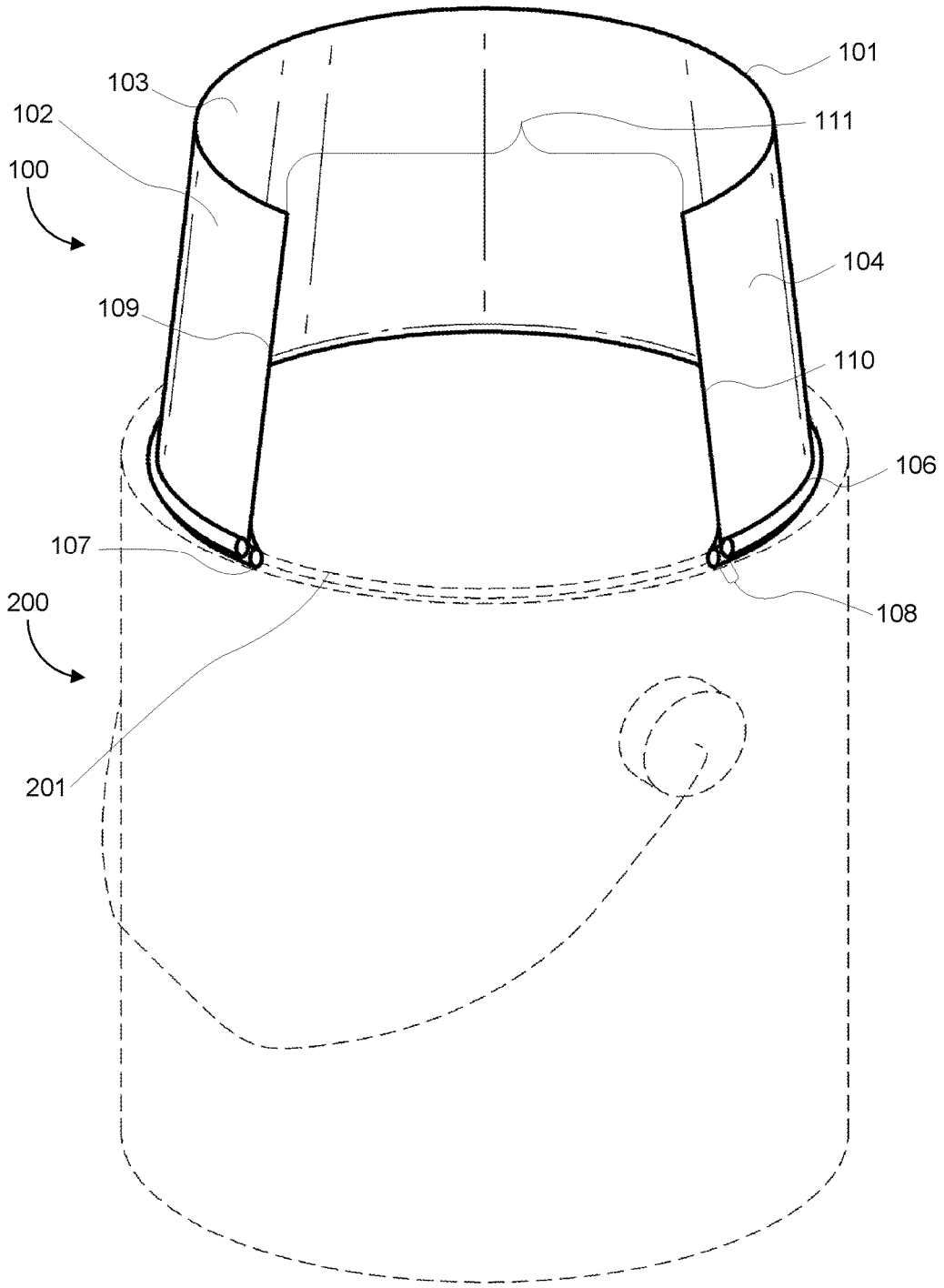
FIG. 2 is an environmental view of one embodiment the detachable spout coupled with a container.

FIG. 2 is an environmental view of one embodiment of spout 100, shown temporarily coupled with a paint can 200. It should be understood that the choice of paint can 200 is exemplary only, and spout 100 is coupleable with many types of containers, including but not limited to buckets, jugs, cans, jars, bottles, and other types of containers. FIG. 2 shows spout 100 coupled with paint can 200 via lower rim 105, wherein upper lip 106 is disposed on top of rim 201, and lower lip 107 is disposed below rim 201. In such a configuration, spout 100 may be held against rim 201 by the grip strength or frictional force exerted on the upper and lower surfaces of the rim by upper lip 106 and lower lip 107, respectively. Spout 100 may be held to rim 201 by a force exerted outwardly away from a longitudinal axis of the spout, such that the spout would spring open but for the force exerted upon it by the rim. This force may be derived from either upper rim 101 or lower rim 105 being semi-rigid and therefore resistant to curving. It may be derived from body 102 being semi-rigid and resistant to curving. Spout 100 may be held to rim 201 by a combination of forces, such as the frictional force exerted by lower rim 105 and the pressing force described above. Spout 100 may be coupled with container 200 with any number of forces without altering the function of the spout.

When coupled with a container as demonstrated in FIG. 2, spout 100 may have a considerable gap 111 formed by edges 109 and 110. Gap 111 may be purely aesthetic. In some embodiments, gap 111 may be wide enough that a scraper, paint brush, or other tool can pass between left edge 109 and right edge 110, allowing a user to more easily move contents from the container through the spout, or allowing a user to wipe a tool on inner surface 103 to help control mess. In some embodiments, inner surface 103 may be coated with a corrosion or stain-resistant material. In some embodiments, outer surface 104 may also be coated with a protective material. In some embodiments, body 102 may be comprised of a single material, such that inner surface 103 and outer surface 104 are two sides of a single sheet of material. In other embodiments, inner surface 103 and outer surface 104 may be two or more layers of material joined to form body 102. In some embodiments, body 102, and lips 106 and 107 may be the same material. In other embodiments, body 102, upper lip 106, and lower lip 107 may all be different materials. In some embodiments, body 102 may be the same material as only one of upper lip 106 or lower lip 107. In some embodiments, one or both of upper lip 106 and lower lip 107 may be comprised of a rod or tubular member disposed within the material of body 102 to add different materials properties, such as rigidity or heat resistance, to the lips. In other embodiments, one or both of upper lip 106 and lower lip 107 may be entirely different materials from body 102 in order to alter materials properties. In a preferred embodiment, body 102 will be semi-flexible, and at least one of upper lip 106 and lower lip 107 will be substantially rigid, allowing the lips to properly grip a rim 201 and exert an outward force to keep spout 100 open.

Figure 3:
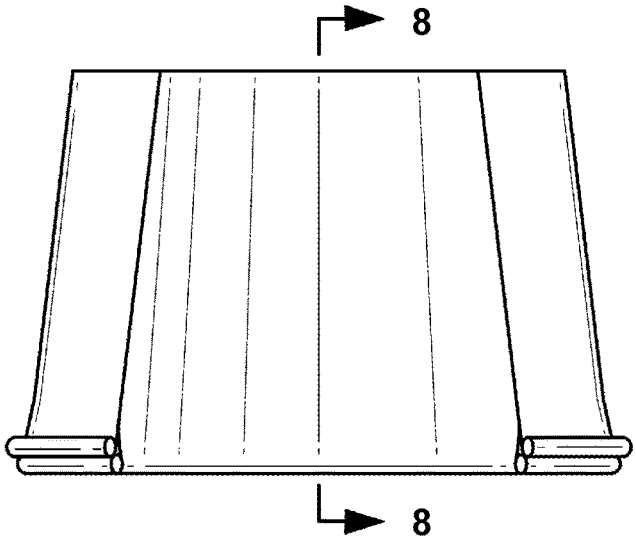
FIG. 3 is a front view thereof.
Figure 4:
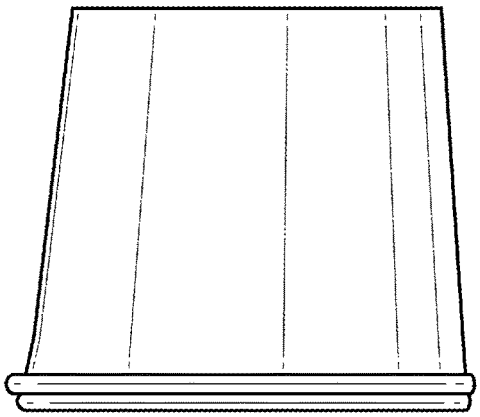
FIG. 4 is a side view thereof.
Figure 5:
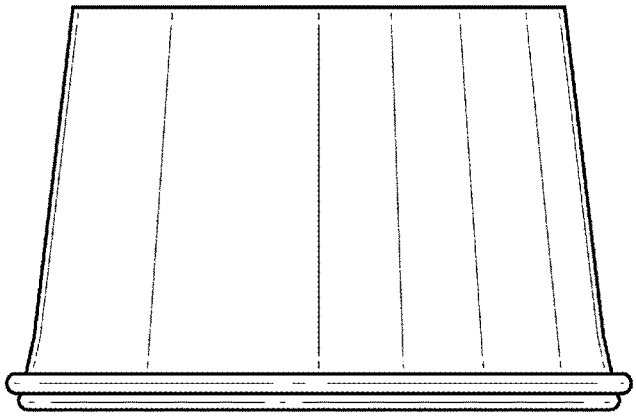
FIG. 5 is a rear view thereof.
Figure 6:
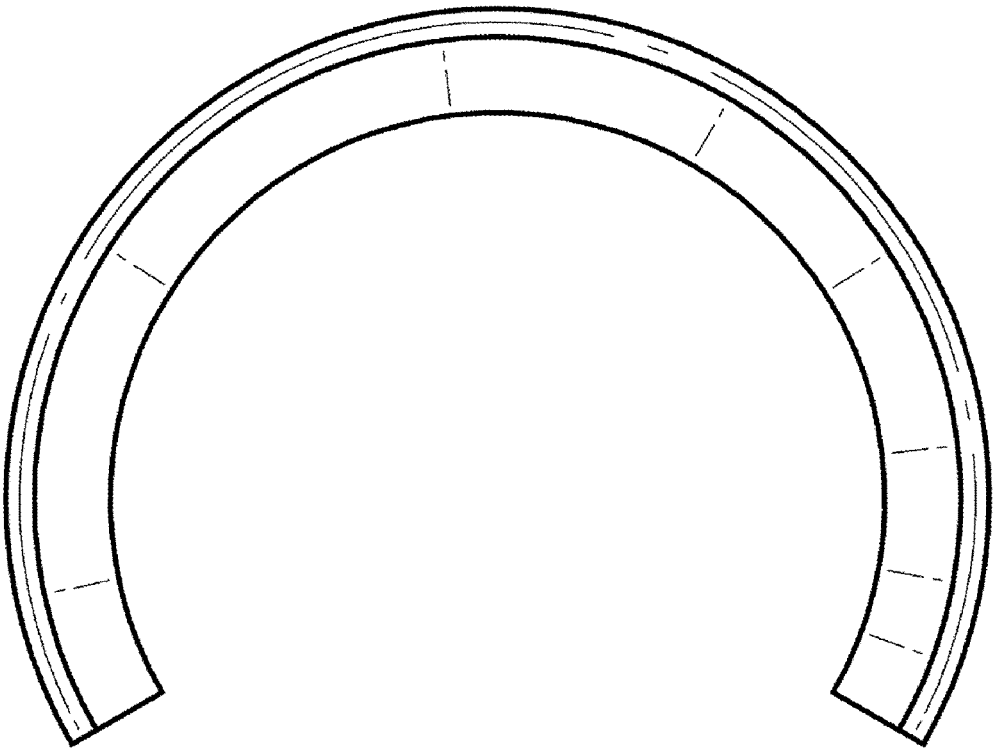
FIG. 6 is a top view thereof.
Figure 7:
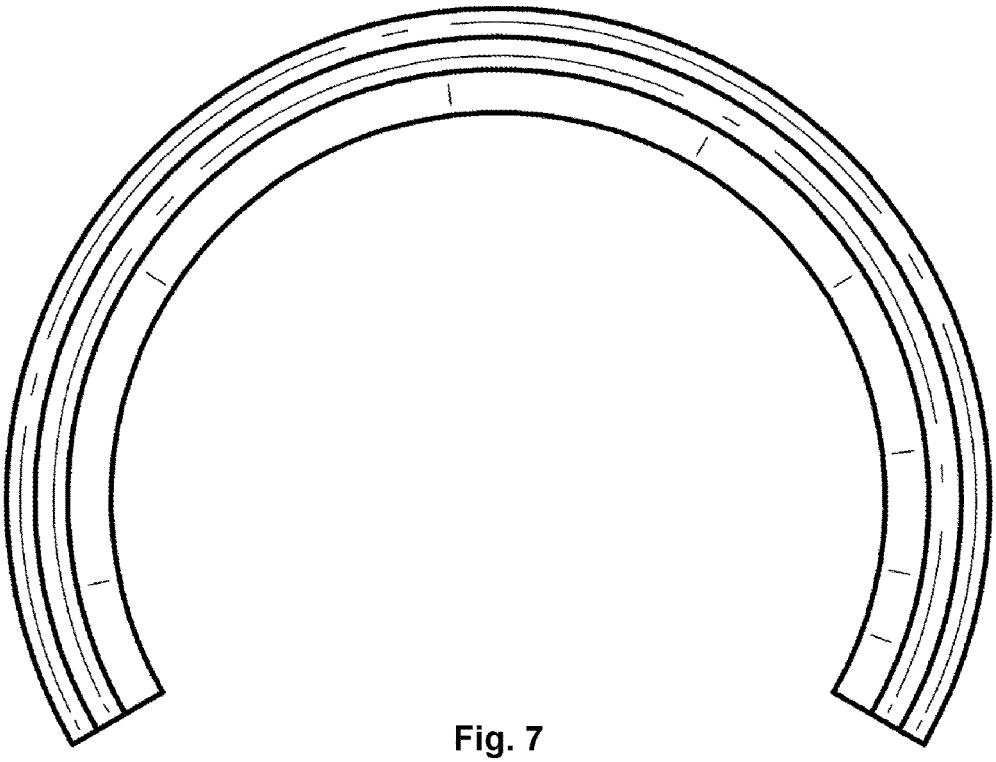
FIG. 7 is a bottom view thereof.

FIGS. 3, 4, and 5 are front, side, and rear views, respectively, of one embodiment of spout 100. These views show that, in one exemplary embodiment, spout 100 is substantially conical in shape, with a narrower top and wider bottom. FIGS. 6 and 7 are top and bottom views, respectively, of one embodiment of spout 100. These views show that, in one exemplary embodiment, spout 100 holds a semi-circular profile from top and bottom.

Figure 8:
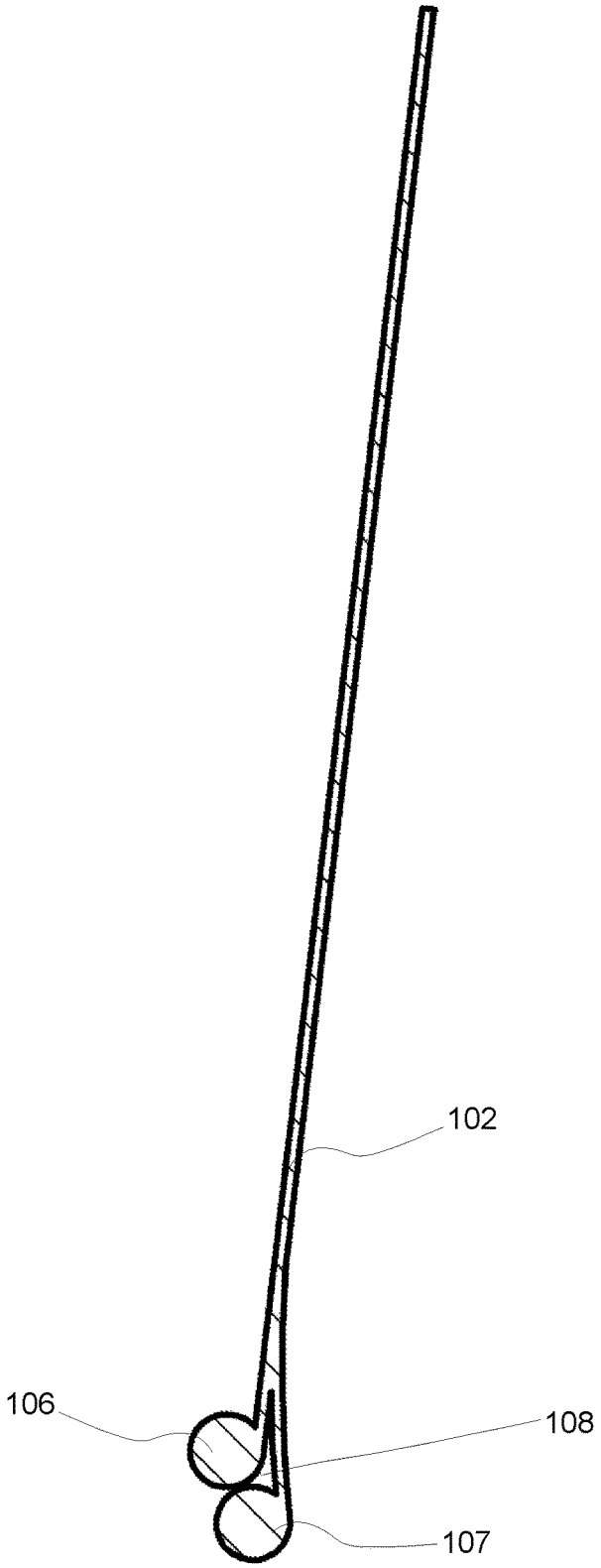
FIG. 8 is is a cross-sectional view thereof.

FIG. 8 is a cross-sectional view of one embodiment of spout 100, taken from the perspective denoted in FIG. 3. In this embodiment, it's clear that body 102 extends to couple with lower lip 107, which forms a gap 108 with upper lip 106, wherein the gap is backed by the body. Gap 108 allows a rim of a container to fit snugly between upper lip 106 and lower lip 107, holding spout 100 onto the rim of the container. As before, this is but one exemplary embodiment, and the manner in which upper lip 106 and lower lip 107 couple with body 102 and with the other lip can vary without altering the function of spout 100.

Figure 9:
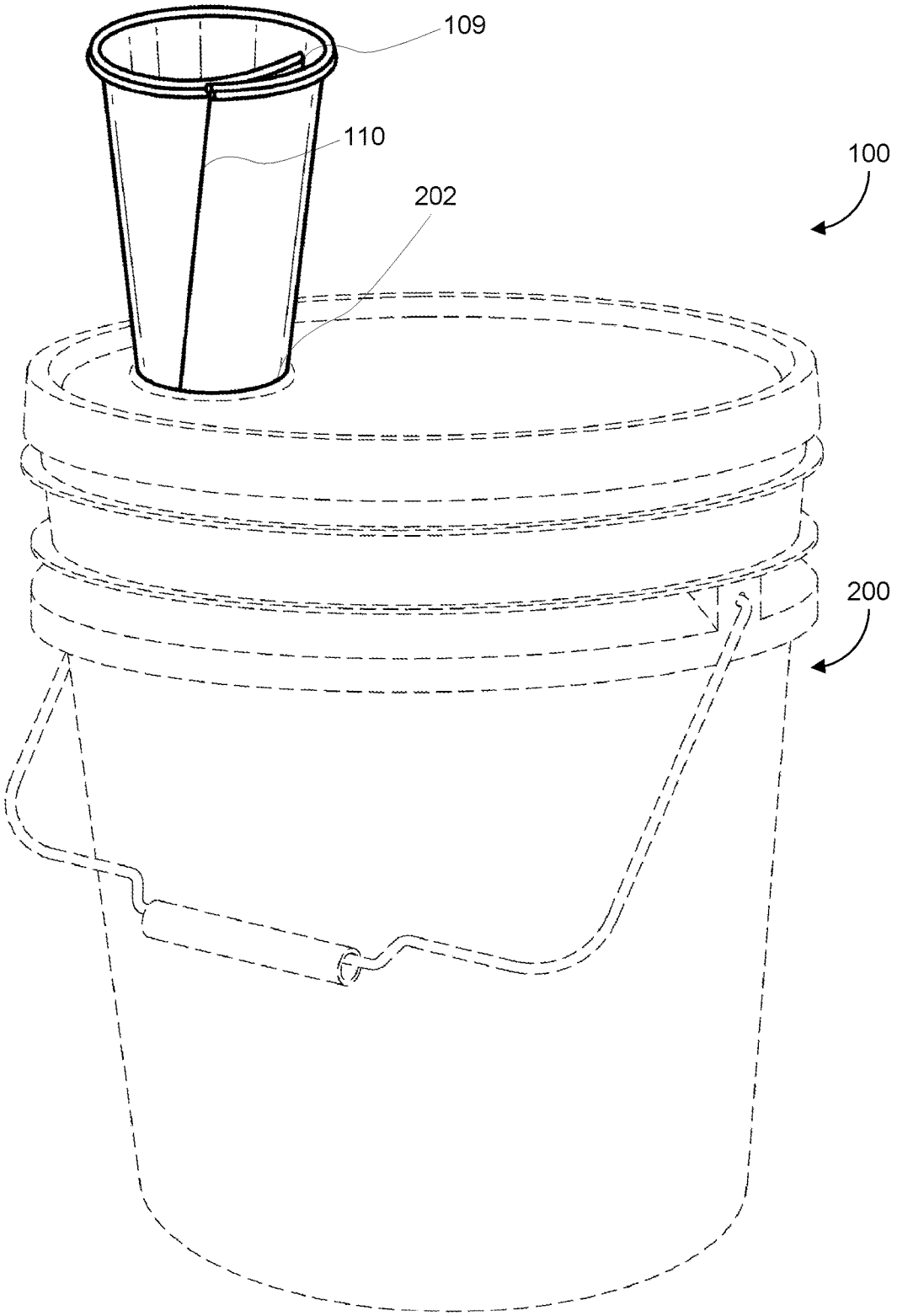
FIG. 9 is an environmental view of another embodiment of the detachable spout coupled with a container.

FIG. 9 is an environmental view of another use of spout 100. As discussed with FIG. 1, in some embodiments spout 100 is capable of being rolled or folded. In a further embodiment, rolling or folding spout 100 such that edge 109 is passed by edge 110 to eliminate gap 111 forms a smaller-profile spout or funnel. In such an embodiment, upper rim 101, not depicted, is inserted into a smaller profile hole 202 to allow pouring from or into a container. This is useful in the case of a large bucket with a lid, as depicted in FIG. 9, but also for use with smaller containers such as bottles, jugs, or jars such as Mason jars.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A spout, comprising:
an upper rim;
a lower rim, wherein the lower rim includes a grip running longitudinally with the rim,
the grip including at least:
an upper lip; and
a lower lip;
a body portion disposed between the upper rim and the lower rim, the body portion including at least:
a first edge and a second edge, wherein folding the first edge over the second edge forms a cone; and
wherein the upper rim, lower rim, and body portion form a perimeter that is substantially trapezoidal in shape.

2. The spout of claim 1, wherein the spout is configured to be rolled into a partial cone.

3. The spout of claim 1, wherein the grip is configured for receiving a rim of at least one of a bottle, can, jar, or bucket.

4. A spout, comprising:
an upper rim;
a lower rim, the lower rim including:
an upper lip; and
a lower lip; and
a substantially trapezoidal body portion disposed between and coupled with the upper rim and the lower rim, the body portion including at least:
a first edge and a second edge, wherein the edges form angular sides of the substantially trapezoidal body portion;
wherein the upper rim forms a shorter leg of the trapezoid; and
wherein the lower rim forms a longer leg of the trapezoid.

5. The spout of claim 4, wherein the upper lip and the lower lip form a gap along the lower rim of the spout.

6. The spout of claim 5, wherein the gap between the upper lip and the lower lip is comprised of the same material as the body portion.

7. The spout of claim 4, wherein the upper rim and the body portion are semi-flexible.

8. The spout of claim 4, wherein the lower rim is semi-flexible longitudinally.

9. The spout of claim 4, wherein the lower rim is rigid transversely.

10. The spout of claim 4, wherein the upper rim and the body portion are semi-flexible.

11. The spout of claim 4, wherein the lower rim is semi-flexible longitudinally.

12. The spout of claim 4, wherein the lower rim is rigid transversely.

13. The spout of claim 4, wherein the spout is configured to be substantially conical in shape when rolled.

14. The spout of claim 13, wherein the lower rim exerts a lateral force extending outwardly away from a longitudinal axis of the cone.

15. The spout of claim 4, wherein the lower rim exerts a lateral force extending outwardly away from a longitudinal axis of the spout.

* * * * *